US008695392B2

(12) United States Patent
Norikura

(10) Patent No.: US 8,695,392 B2
(45) Date of Patent: Apr. 15, 2014

(54) ROLLING MILL AND TANDEM ROLLING MILL HAVING THE SAME

(75) Inventor: Takashi Norikura, Tokyo (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 746 days.

(21) Appl. No.: 12/812,395

(22) PCT Filed: Jan. 15, 2009

(86) PCT No.: PCT/JP2009/050410

§ 371 (c)(1),
(2), (4) Date: Sep. 8, 2010

(87) PCT Pub. No.: WO2009/093510

PCT Pub. Date: Jul. 30, 2009

(65) Prior Publication Data

US 2011/0005290 A1 Jan. 13, 2011

(30) Foreign Application Priority Data

Jan. 25, 2008 (JP) ..... 2008-014473

(51) Int. Cl.
*B21B 13/08* (2006.01)
*B21B 27/02* (2006.01)

(52) U.S. Cl.
USPC ..... 72/234; 72/252.5

(58) Field of Classification Search
USPC ..... 72/234, 241.2, 224, 252.5
See application file for complete search history.

(56) References Cited

U.S. PATENT DOCUMENTS

| | | | | |
|---|---|---|---|---|
| 5,799,527 | A * | 9/1998 | Kenmochi et al. | 72/252.5 |
| 6,230,534 | B1 | 5/2001 | Sato et al. | |
| 7,004,002 | B2 * | 2/2006 | Nishi et al. | 72/229 |
| 7,181,949 | B2 * | 2/2007 | Haberkamm et al. | 72/243.6 |
| 2002/0043087 | A1 | 4/2002 | Kobayashi et al. | |

FOREIGN PATENT DOCUMENTS

| | | | |
|---|---|---|---|
| DE | 102 08 389 | A1 | 6/2003 |
| EP | 0 534 602 | A2 | 3/1993 |
| JP | 5-50109 | A | 3/1993 |
| JP | 2002-66608 | A | 3/2002 |
| JP | 3382874 | B2 | 3/2003 |

OTHER PUBLICATIONS

European Search Report dated Jun. 24, 2013 for EP Application No. 09 70 4554.

* cited by examiner

*Primary Examiner* — Teresa M Ekiert
(74) *Attorney, Agent, or Firm* — Birch, Stewart, Kolasch & Birch, LLP

(57) ABSTRACT

A rolling mill, which can use work rolls of a smaller diameter for rolling a hard material and a thin strip material, and can obtain strips of high product quality with high productivity, is provided. For this purpose, a six-high rolling mill includes upper and lower work rolls (2) as a pair for rolling a strip (1), upper and lower intermediate rolls (3) as a pair for supporting the paired upper and lower work rolls, and upper and lower back-up rolls (4) as a pair for supporting the paired upper and lower intermediate rolls, but has no supporting rolls inside and outside the rollable strip width of the work rolls. The work rolls have a small diameter, and use a material having a high longitudinal modulus, such as a hard metal or a ceramic.

4 Claims, 8 Drawing Sheets

ROLLING MILL AND TANDEM ROLLING MILL HAVING THE SAME

TECHNICAL FIELD

This invention relates to a rolling mill, which can render the diameter of work rolls small, and a tandem rolling mill equipped with the rolling mill.

BACKGROUND ART

In a conventional so-called intermediate roll-drive six-high rolling mill (hereinafter referred to as a six-high mill), the minimum value of the work roll diameter is determined by the flexural rigidity value of the work rolls, which withstands the tangential force of the intermediate roll drive, if there are no support rolls on portions of the work rolls inside and outside the rollable strip width of the work rolls. According to Non-Patent Document 1, for example, this value is 180 mm to 380 mm in the case of a 4-feet width material upon the intermediate roll drive.

A conventional six-high mill may have support rolls inside the rollable strip width of the work rolls. Further, a six-high mill, which has support bearings provided outside the rollable strip width of the work rolls, and applies horizontal bending to the work rolls via these support bearings, is disclosed in Patent Document 1.

Non-Patent Document 1: "Industrial Machinery", May Issue, 1991 (pp. 56-60)

Patent Document 1: JP-A-5-50109

DISCLOSURE OF THE INVENTION

Problems to be Solved by the Invention

To meet recent needs, an attempt has been made to roll a special steel, such as a harder stainless steel, by a six-high mill having no support rolls inside the rollable strip width of the work rolls. This attempt has posed a problem such that the aforementioned work roll diameter is too large and imposes a heavy load, thus failing to ensure a necessary reduction in thickness by rolling, and a problem such as poor gloss.

On the other hand, a six-high mill having support rolls inside the rollable strip width of the work rolls has involved the following problems: A space for the support roll portion is so small that sufficient strength and rigidity are difficult to ensure. Since there are support bearings for supporting the support rolls inside the rollable strip width of the work roll, moreover, marks of the support bearings are transferred to or produced in the strip via the support rolls and the work rolls, depending on their material.

A rolling mill having supporting bearings provided outside the rollable strip width of the work rolls has the problems that since the upper and lower supporting bearings are of the same phase, the bearings of a large size cannot be used, and the bearings applied cannot be adopted for heavy load, high torque rolling of a hard material which causes a great horizontal force.

The present invention has been accomplished in the light of these circumstances. It is an object of the present invention to provide a rolling mill, which can render work rolls of a smaller diameter usable for the purpose of rolling a hard material, and can thereby obtain strips with high productivity and of high product quality, and a tandem rolling mill equipped with the rolling mill.

Means for Solving the Problems

The rolling mill according to the present invention, intended to solve the above-mentioned problems, is a six-high rolling mill including upper and lower work rolls as a pair for rolling a metal strip, upper and lower intermediate rolls as a pair for supporting the work rolls, and upper and lower back-up rolls as a pair for supporting the paired upper and lower intermediate rolls, the six-high rolling mill having no supporting rolls inside and outside a rollable strip width of the work rolls, wherein the work roll uses a material having a high modulus of longitudinal elasticity (i.e., longitudinal modulus), and a minimum roll diameter of the work roll is intermediate between a minimum diameter upper limit Dmax1 and a minimum diameter lower limit Dmin1, and these parameters are expressed by the following equations:

$$D\max 1 = D4\max \times B/K^{(1/4)}$$

where D4max; minimum diameter upper limit of conventional work roll with strip width of 1,300 mm: 380 mm B; strip width (mm)/1,300 mm K; ratio for modulus of longitudinal elasticity of high longitudinal modulus material to conventional material (modulus of longitudinal elasticity of high longitudinal modulus material/modulus of longitudinal elasticity of conventional material (21,000 kg/mm$^2$))

$$D\min 1 = D4\min \times B/K^{(1/4)}$$

where D4min; minimum diameter lower limit of conventional work roll with strip width of 1,300 mm: 180 mm The rolling mill is also characterized in that the ratio for modulus of longitudinal elasticity of the high longitudinal modulus material to the conventional material (longitudinal modulus ratio K)=1.2 to 3.0.

The tandem rolling mill according to the present invention, intended to solve the aforementioned problems, is a tandem rolling mill including a plurality of rolling mill stands arranged therein, wherein any one of the above-mentioned rolling mills is provided as at least one of the stands.

Effects of the Invention

According to the features of the present invention, the material having a high longitudinal modulus is used for the work roll. Thus, the flexural rigidity of the work roll can be ensured, and the diameter of the work roll can be rendered small in correspondence with the high rigidity. Moreover, edge drops can be decreased, surface gloss can be improved, and the minimum rollable strip thickness can be reduced. Furthermore, the work rolls can be applied to a heavy load, high torque rolling mill for a hard material.

DESCRIPTION OF THE NUMERALS

1 Strip
2 Work roll
3 Intermediate roll
4 Back-up roll
5*a*, 5*b* Pass line adjusting device
6*a*, 6*b* Hydraulic cylinder
7*a*, 7*b* Housing
13*a* to 13*d* Work roll bearing housing
15*a* to 15*d* Intermediate roll bearing housing
17*a* to 17*d*, 19*a* to 19*d* Back-up roll bearing housing
14*a* to 14*d* Work roll bending cylinder
16*a* to 16*d* Intermediate roll bending cylinder

BEST MODE FOR CARRYING OUT THE INVENTION

A rolling mill and a tandem rolling mill equipped therewith, according to the present invention, will be described in detail by the following embodiments using drawings.

Embodiment 1

Figure 1:
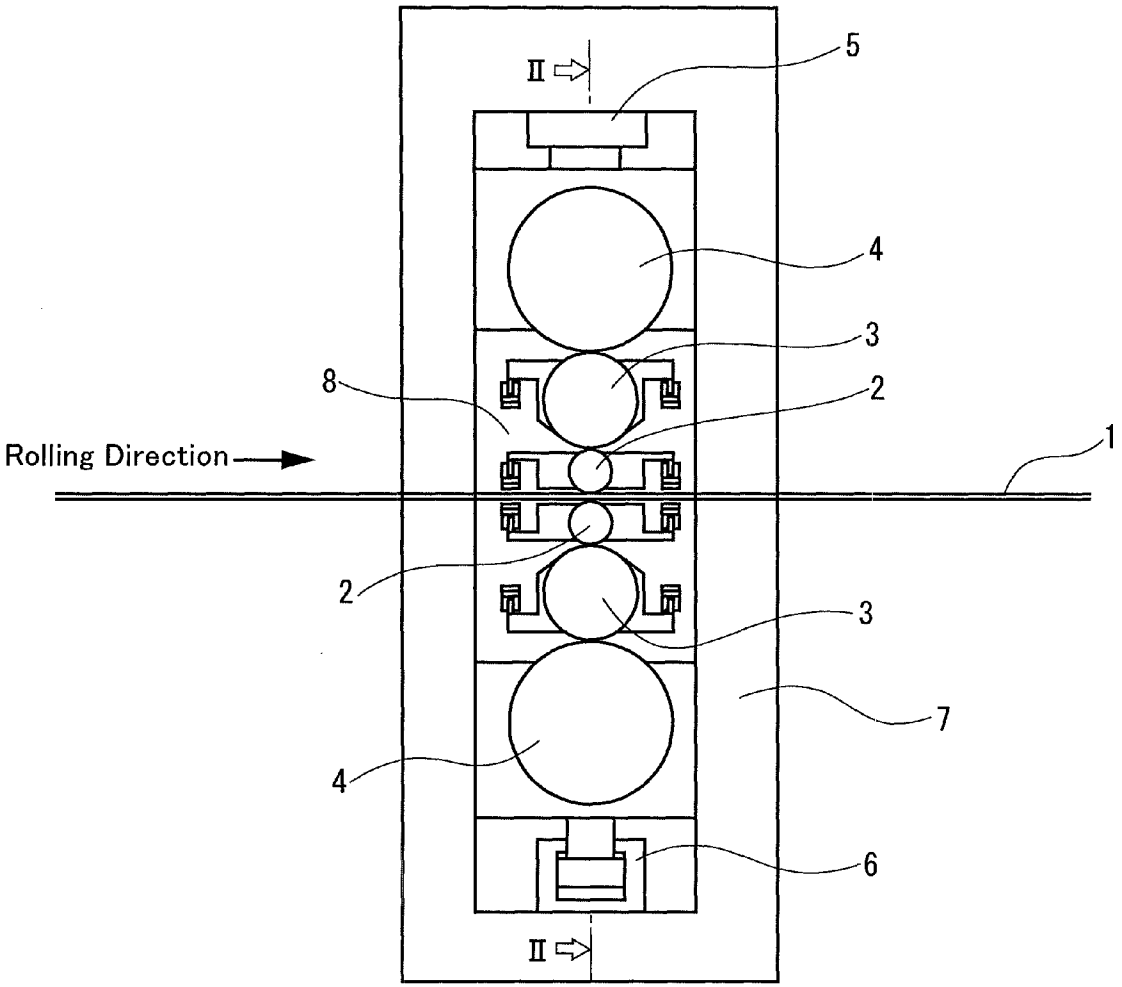
[FIG. 1] is a front sectional view of a six-high mill showing an embodiment of the present invention.
Figure 2:
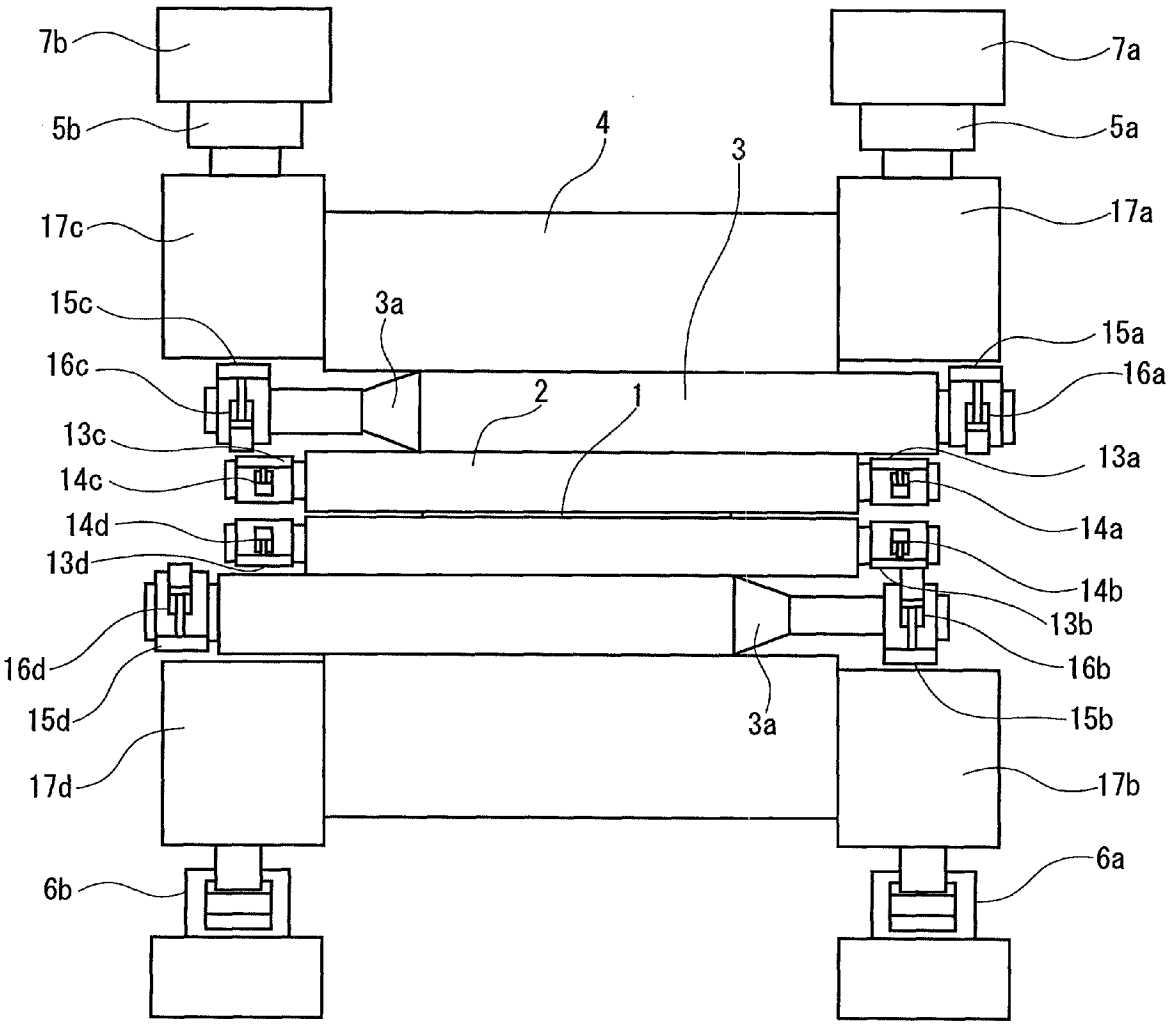
[FIG. 2] is a sectional view taken along line II-II in FIG. 1.

FIG. 1 is a front sectional view of a six-high mill showing Embodiment 1 of the present invention. FIG. 2 is a sectional view taken along line II-II in FIG. 1.

As shown in the drawings, a strip 1, which is a material to be rolled, is rolled by upper and lower work rolls 2 as a pair. These paired upper and lower work rolls 2 are in contact with, and supported by, upper and lower intermediate rolls 3 as a pair. These paired upper and lower intermediate rolls 3 are in contact with, and supported by, upper and lower back-up rolls 4 as a pair.

The upper back-up roll 4 is supported by bearing housings 17*a*, 17*c* via bearings (not shown), and these bearing housings 17*a*, 17*c* are supported by housings 7*a*, 7*b* via pass line adjusting devices 5*a*, 5*b* such as worm jacks or taper wedges and stepped rocker plates. Here, load cells may be incorporated inside the pass line adjusting devices 5*a*, 5*b* to measure a rolling load.

The lower back-up roll 4 is supported by bearing housings 17*b*, 17*d* via bearings (not shown), and these bearing housings 17*b*, 17*d* are supported by the housings 7*a*, 7*b* via hydraulic cylinders 6*a*, 6*b*.

The paired upper and lower work rolls 2 use a material having a high longitudinal modulus. An example of the material having a high longitudinal modulus is a hard metal such as tungsten carbide (longitudinal modulus: 53,000 kg/mm$^2$), or a ceramic (longitudinal modulus: 31,000 kg/mm$^2$). As a conventional material, special forging steel (longitudinal modulus: 21,000 kg/mm$^2$) has been used.

It is preferred that the ratio of the high longitudinal modulus material to the conventional material (longitudinal modulus ratio K) be set at 1.2 to 3.0.

Further, bearing housings 13*a* to 13*d* are mounted on roll neck portions of the paired upper and lower work rolls 2 via bearings (not shown). These bearing housings 13*a* to 13*d* are furnished with bending cylinders 14*a* to 14*d* for imparting roll bending. By so doing, roll bending is imparted to the work rolls 2.

The present embodiment shows a case where the bearing housings 13*a* to 13*d* are present, but these bearing housings 13*a* to 13*d* may be absent. The work rolls 2 without the bearing housings 13*a* to 13*d* are advantageous in that their structure is simple and they have good work efficiency. In this case, however, thrust bearings which bear a thrust load are needed at the roll ends.

Here, the rolling load is imparted by the hydraulic cylinders 16*a*, 16*b*, and rolling torque is transmitted by the intermediate roll 3 by a spindle (not shown). The paired upper and lower intermediate rolls 3 have roll shoulders 3*a*, whose roll diameter decreases, at the positions of the roll barrel ends in vertical point symmetry with respect to the center of the strip width of the strip 1.

The paired upper and lower intermediate rolls 3 are supported by bearing housings 15*a* to 15*d* via bearings (not shown). The paired upper and lower intermediate rolls 3 are axially movable by shifting devices (not shown) via the drive-side bearing housings 15*c*, 15*d*. Further, these bearing housings 15*a* to 15*d* are furnished with bending cylinders 16*a* to 16*d* for imparting roll bending. By so doing, roll bending is imparted to the intermediate rolls 3.

Deflection of the work roll by the driving tangential force will be described using FIG. 3 and FIG. 4.

Figure 3:
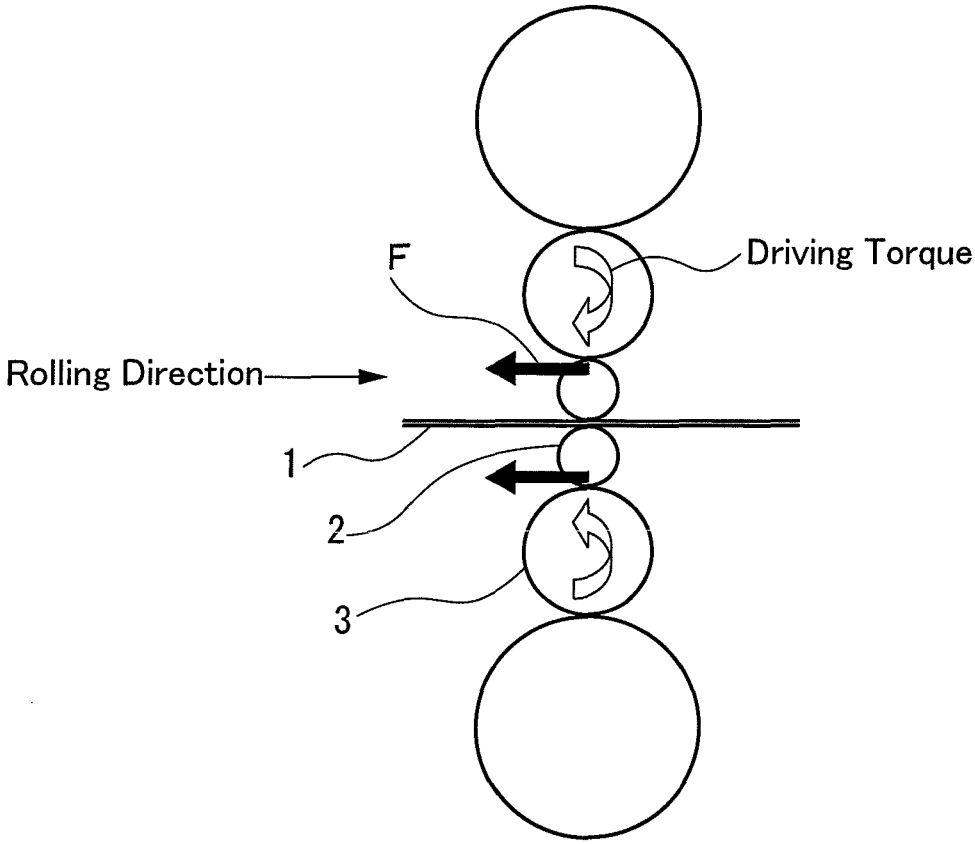
[FIG. 3] is an explanation drawing of a driving tangential force.
Figure 4:
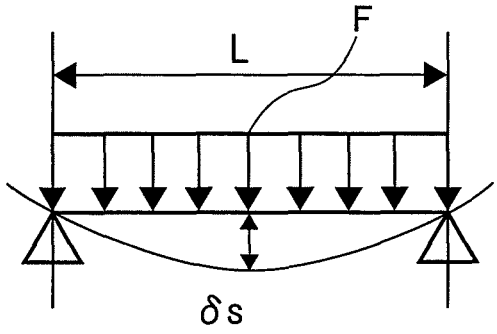
[FIG. 4] is an explanation drawing of the deflection of a work roll.

As shown in FIG. 3, when driving torque is transmitted from the intermediate roll 3 to the work roll 2, driving tangential force F is exerted on the work roll 2. Since the number of the bearings for the conventional work roll is one each on the operating side and on the drive side, the supporting conditions for simple support shown in FIG. 4 apply. Horizontal deflection δs of the work roll in this case is expressed by the following equation (1), where F represents the driving tangential force per unit length, L represents the support spacing, Dc represents the diameter of the conventional work roll 2, Ic represents the second moment of area of the conventional work roll diameter, and Ec represents the longitudinal modulus (21,000 kg/mm$^2$) of the material (special forging steel) of the conventional work roll:

$$\delta s = 5 \times F \times L^4 / (384 \times Ec \times Ic) \qquad \text{Equation (1)}$$

where $Ic = \pi \times Dc^4/64$

The material having a high longitudinal modulus is used for the paired upper and lower work rolls 2. Deflection δr in the horizontal direction of the work roll 2 in this case is expressed by the following equation (2), where Dr represents the diameter of the work roll 2 of the embodiment, Ir represents the second moment of area of the diameter of the work roll of the embodiment, and Er represents the longitudinal modulus of the material of the work roll of the embodiment:

$$\delta r = 5 \times F \times L^4 / (384 \times Er \times Ir) \qquad \text{Equation (2)}$$

where $Ir = \pi \times Dr^4/64$

Assuming that δr=δs, Dr is expressed by the following equation (3):

$$Dr = Dc / K^{(1/4)} \qquad \text{Equation (3)}$$

On the other hand, the minimum roll diameter of the work roll is similarly intermediate between the minimum diameter upper limit Dmax1 and the minimum diameter lower limit Dmin1, and these parameters are expressed by the following equation (4):

$$D\max 1 = D4\max \times B / K^{(1/4)} \qquad \text{Equation (4)}$$

where D4max; minimum diameter upper limit of conventional work roll with strip width of 1,300 mm: 380 mm B; strip width (mm)/1,300 mm K; ratio for modulus of longitudinal elasticity of high longitudinal modulus material to conventional material (modulus of longitudinal elasticity of high longitudinal modulus material/modulus of longitudinal elasticity of conventional material (21,000 kg/mm$^2$))

Figure 5:
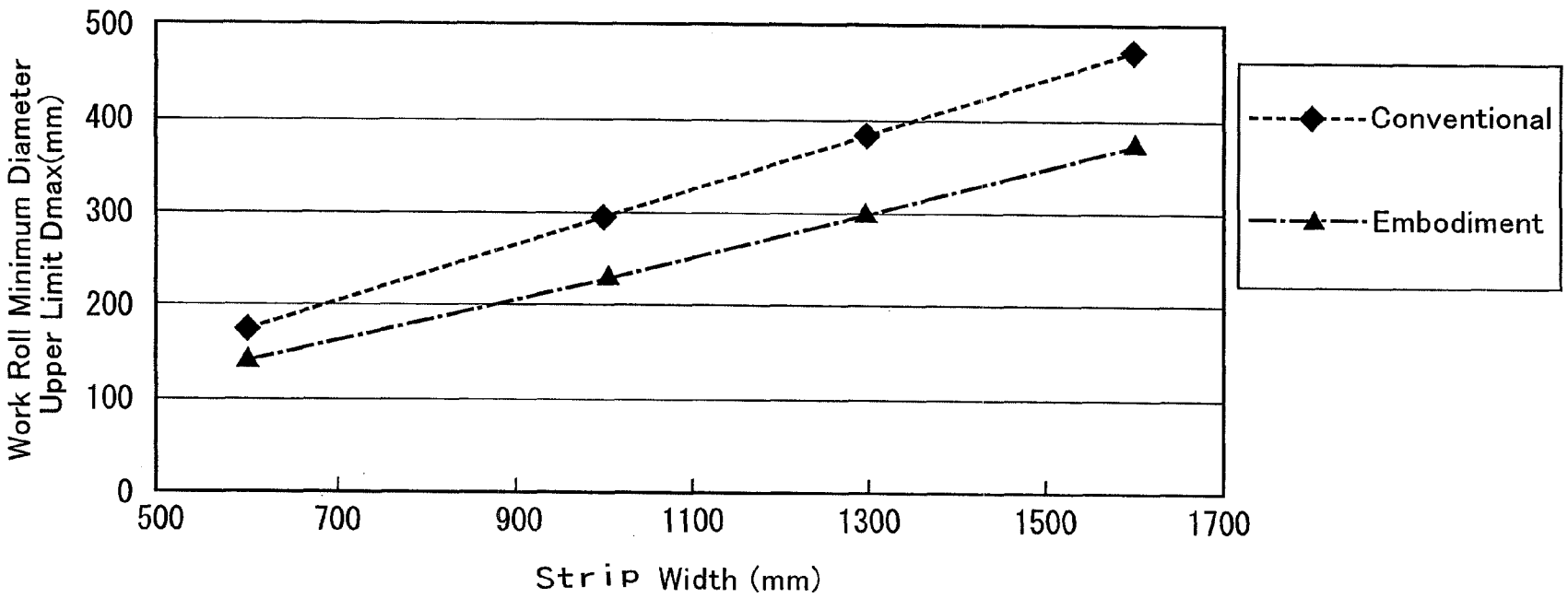
[FIG. 5] is a graph showing the work roll minimum diameter upper limit Dmax in the embodiment of the present invention.
Figure 6:
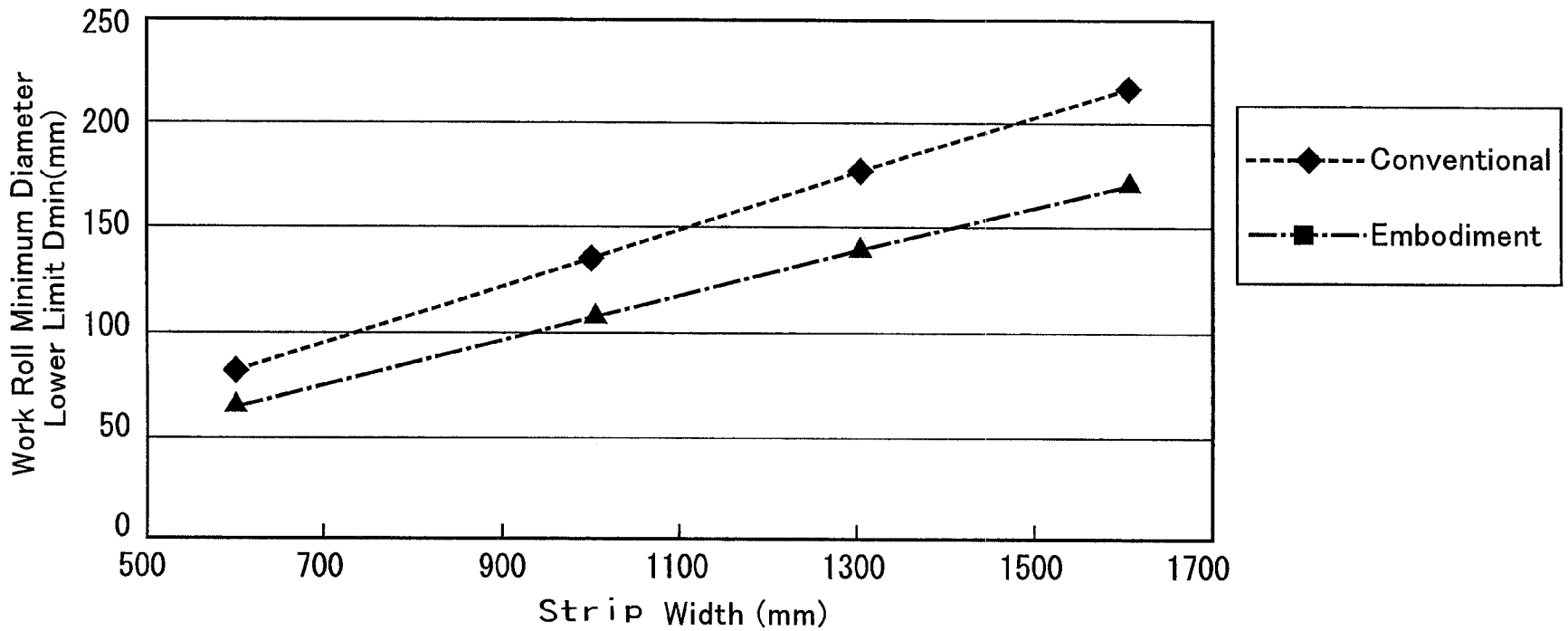
[FIG. 6] is a graph showing the work roll minimum diameter lower limit Dmin in the embodiment of the present invention.

The minimum diameter upper limit Dmax1 per strip width in the embodiment is shown in FIG. 5. K=2.5, provided that the material of the work roll was a hard metal.

$$Dmin1=D4min\times B/K^{(1/4)} \quad \text{Equation (5)}$$

where D4min; minimum diameter lower limit of conventional work roll with strip width of 1,300 mm: 180 mm The minimum diameter lower limit Dmin1 per strip width in the embodiment is shown in FIG. 6. K=2.5, provided that the material of the work roll was a hard metal.

In the present embodiment, as describe above, the work roll 2 composed of a hard metal or ceramic material, which is a high longitudinal modulus material, is used in the six-high mill having no supporting rolls inside and outside the rollable strip width of the work rolls 2. Thus, the flexural rigidity of the work roll is ensured, and the diameter of the work roll can be rendered small in correspondence with the high rigidity. As a result, the strip 1 of high product quality can be obtained with high productivity by the rolling of a hard material.

Figure 7A:
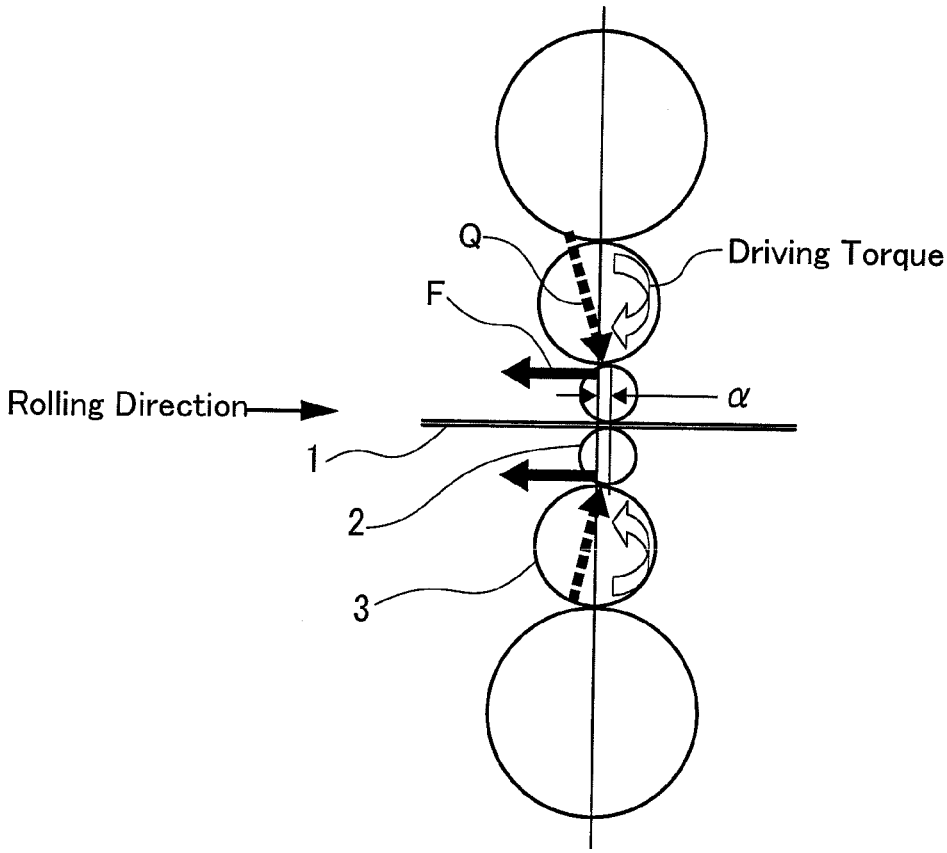
[FIG. 7A] is an explanation drawing of a work roll offset showing another embodiment of the present invention.
Figure 7B:
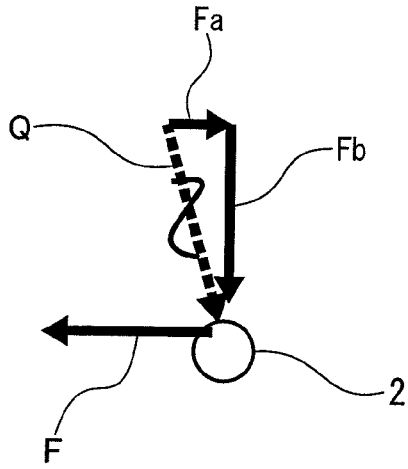
[FIG. 7B] is an explanation drawing of the work roll offset showing the another embodiment of the present invention.

As shown in FIGS. 7A and 7B, the work rolls 2 composed of the high longitudinal modulus material may be offset variably, according to the driving torque, toward the outlet side in the rolling direction in the horizontal direction. By so doing, the driving tangential force F is decreased by the offset horizontal component force Fa of the rolling load Q, so that the total force in the horizontal direction exerted on the work roll 2 is decreased. In FIG. 7B, Fb represents the offset vertical component force of the rolling load Q.

As a result, the advantage is produced that the deflection of the work roll 2 can be further diminished.

The total force Fw in the horizontal direction exerted on the work roll 2 is expressed by the following equation (6):

$$Fw=F-Q\times\alpha/((Dw+DI)/2) \quad \text{Equation (6)}$$

where Dw represents the diameter of the work roll, and DI represents the diameter of the intermediate roll.

Figure 8A:
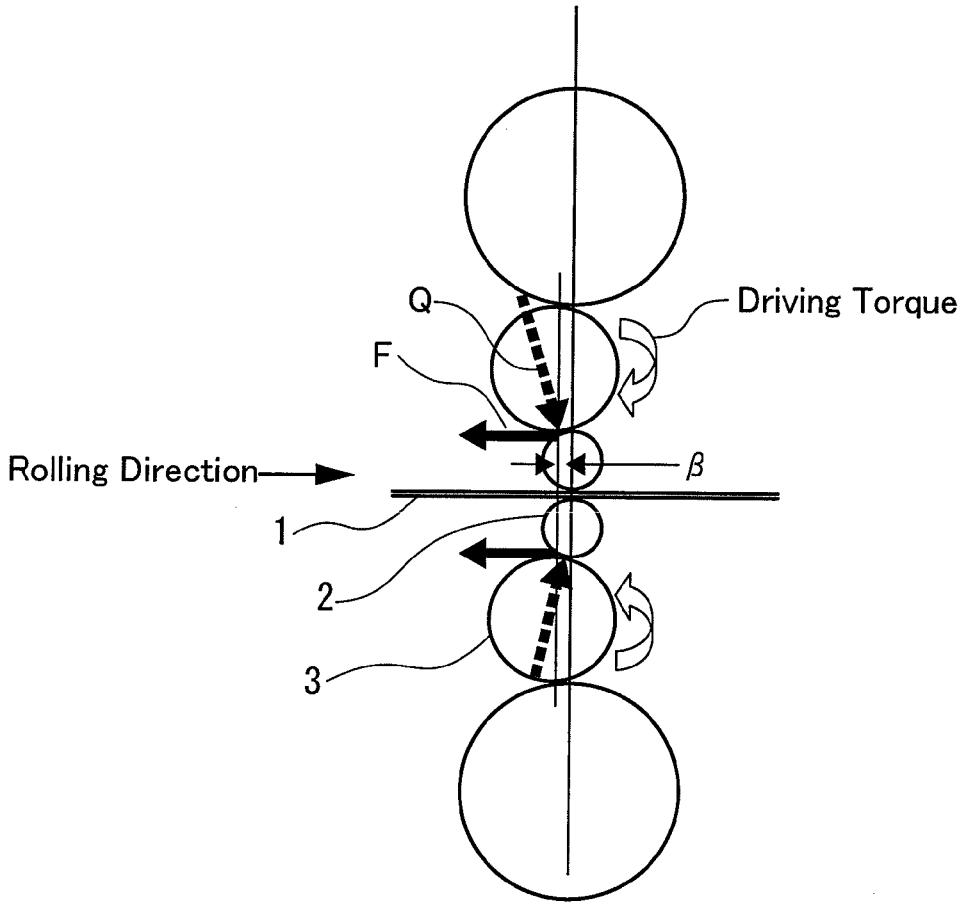
[FIG. 8A] is an explanation drawing of an intermediate roll offset showing still another embodiment of the present invention.
Figure 8B:
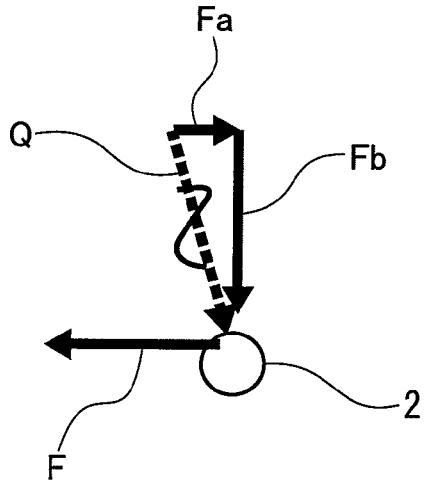
[FIG. 8B] is an explanation drawing of the intermediate roll offset showing the still another embodiment of the present invention.

As shown in FIGS. 8A and 8B, the intermediate rolls 3 may be offset variably, according to the driving torque, toward the inlet side in the rolling direction in the horizontal direction. By so doing, the driving tangential force F is decreased by the offset horizontal component force Fa of the rolling load Q, so that the total force in the horizontal direction exerted on the work roll 2 composed of the high longitudinal modulus material is decreased. In FIG. 8B, Fb represents the offset vertical component force of the rolling load Q.

As a result, the advantage is produced that the deflection of the work roll 2 can be diminished further.

The total force Fw in the horizontal direction exerted on the work roll 2 is expressed by the following equation (7):

$$FW=F-Q\times\beta/((Dw+DI)/2) \quad \text{Equation (7)}$$

where Dw represents the diameter of the work roll, and DI represents the diameter of the intermediate roll.

Figure 9:
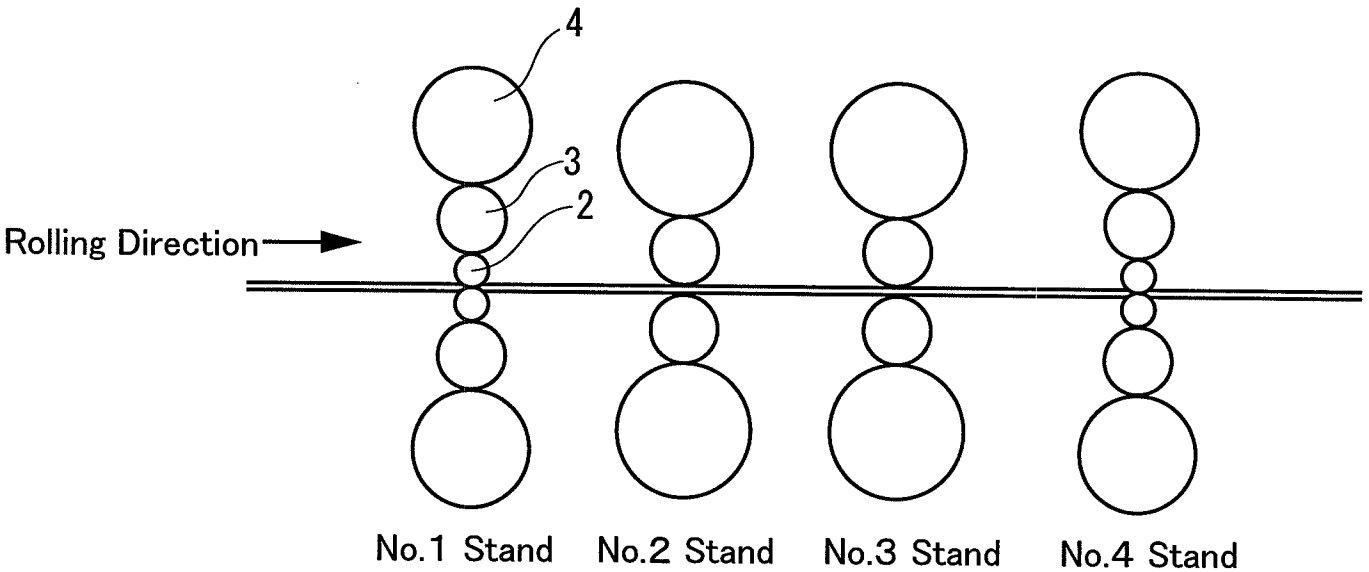
[FIG. 9] is an explanation drawing of the application of the present invention to a tandem rolling mill.

If the rolling mill with small-diameter work rolls according to the present invention is applied to a tandem rolling mill, its application to No. 1 stand enables the small-diameter work rolls composed of the high longitudinal modulus material to impart a great reduction in thickness, as shown in FIG. 9. When it is applied to the final stand, i.e., No. 4 stand in the drawing, a thinner strip can be rolled by the small-diameter work rolls composed of the high longitudinal modulus material. It goes without saying that the rolling mills with the small-diameter work rolls according to the present invention may be applied to all of the stands. This makes it possible to roll a thinner, harder material.

Industrial Applicability

The rolling mill and a tandem rolling mill equipped with it, according to the present invention, is preferred when used as a heavy load, high torque rolling mill for a hard material.

The invention claimed is:

1. A six-high rolling mill including upper and lower work rolls as a pair for rolling a metal strip, upper and lower intermediate rolls as a pair for supporting the work rolls, and upper and lower back-up rolls as a pair for supporting the paired upper and lower intermediate rolls, with only the intermediate rolls having a roll shoulder whose roll diameter decreases, the six-high rolling mill having no supporting rolls inside and extending beyond both sides of a rollable strip width of the work rolls, wherein the work rolls comprise a material having a high modulus of longitudinal elasticity, and a minimum roll diameter of the work rolls is between a minimum diameter upper limit Dmax1 and a minimum diameter lower limit Dmin1, wherein the minimum diameter upper limit Dmax1=D4max×B/K$^{(1/4)}$, where D4max is about 380 mm, corresponding to a minimum diameter upper limit of a work roll with conventional strip width of about 1,300 mm, B is a strip width (mm) of the work rolls/1,300 mm, and K is the ratio for modulus of longitudinal elasticity of the high longitudinal modulus material to a material with conventional modulus of about 21,000 kg/mm$^2$, and the minimum diameter lower limit Dmin1=D4min×B/K$^{(1/4)}$, where D4min is about 180 mm, corresponding to a minimum diameter lower limit of a work roll with conventional strip width of about 1,300 mm.

2. The rolling mill according to claim 1, wherein K=1.2 to 3.0.

3. A tandem rolling mill including a plurality of rolling mill stands arranged therein, wherein the rolling mill according to claim 1 is provided as at least one of the stands.

4. A tandem rolling mill including a plurality of rolling mill stands arranged therein, wherein the rolling mill according to claim 2 is provided as at least one of the stands.

* * * * *